US009856591B2

(12) United States Patent
Ichikawa et al.

(10) Patent No.: US 9,856,591 B2
(45) Date of Patent: Jan. 2, 2018

(54) NONWOVEN FABRIC

(75) Inventors: Taro Ichikawa, Sodegaura (JP); Yoshihisa Kawakami, Yokkaichi (JP)

(73) Assignee: MITSUI CHEMICALS, INC., Tokyo (JP)

( * ) Notice: Subject to any disclaimer, the term of this patent is extended or adjusted under 35 U.S.C. 154(b) by 0 days.

(21) Appl. No.: 13/580,163

(22) PCT Filed: Mar. 9, 2011

(86) PCT No.: PCT/JP2011/055487
§ 371 (c)(1),
(2), (4) Date: Oct. 12, 2016

(87) PCT Pub. No.: WO2011/122277
PCT Pub. Date: Oct. 6, 2011

(65) Prior Publication Data

US 2012/0315440 A1 Dec. 13, 2012

(30) Foreign Application Priority Data

Mar. 30, 2010 (JP) ..... 2010-078216

(51) Int. Cl.
*D04H 3/14* (2012.01)
*D04H 1/54* (2012.01)

(52) U.S. Cl.
CPC ..... *D04H 3/14* (2013.01); *D04H 1/54* (2013.01); *Y10T 428/24479* (2015.01)

(58) Field of Classification Search
CPC ..... D04H 1/54; D04H 3/14; Y10T 428/24479
(Continued)

(56) References Cited

U.S. PATENT DOCUMENTS 8,435,625 B2 5/2013 Ruehe et al.
2004/0067709 A1 4/2004 Kishine et al.

FOREIGN PATENT DOCUMENTS

JP 57-167442 A 10/1982
JP 11-291376 A 10/1999
(Continued)

OTHER PUBLICATIONS

Machine Translation of JP 2005-245483.*
(Continued)

*Primary Examiner* — Brian Handville
(74) *Attorney, Agent, or Firm* — Buchanan, Ingersoll & Rooney PC

(57) ABSTRACT

There is provided a nonwoven fabric excellent in the balance among fuzz resistance, softness and tensile strength. The nonwoven fabric comprises an embossed portion and a non-embossed portion; the embossed portion comprising an emboss pattern that comprises unit patterns each delimited by emboss lines; the emboss lines each comprising a plurality of emboss element parts that are continuously arranged with a predetermined interval; wherein in the direction in which the distance from any arbitrarily-defined point in the non-embossed portion within the unit pattern toward the outside of the emboss lines that delimit the non-embossed portion is shortest, at least one of the plurality of emboss element parts is disposed so as to block the direction in which the distance from the arbitrarily-defined point toward the outside of the emboss lines that delimit the non-embossed portion is shortest.

10 Claims, 8 Drawing Sheets

(58) Field of Classification Search
USPC ..... 428/156
See application file for complete search history.

(56) References Cited

FOREIGN PATENT DOCUMENTS

| | | | |
|---|---|---|---|
| JP | 11-335960 | A | 12/1999 |
| JP | 2003-52749 | A | 2/2003 |
| JP | 2005-245483 | A | 9/2005 |
| JP | 2005-245913 | A | 9/2005 |
| JP | 2006-233345 | A | 9/2006 |
| KR | 10-2006-0038922 | A | 5/2006 |

OTHER PUBLICATIONS

Machine Translation of JP 2005-245913.*
Celanese Acetate, Complete Textile Glossary, 2001, Celanese Acetate LLC, pp. 107 and 150.*
International Search Report (PCT/ISA/210) dated May 24, 2011, by the Japanese Patent Office as the International Searching Authority for International Application No. PCT/JP2011/055487.
Office Action issued by the Korean Patent Office dated Nov. 7, 2013 in corresponding Korean Patent Application No. 10-2012-7027736. (4 pages).
Official Action dated Nov. 25, 2015 in corresponding EP Application No. 11 762 517.8 (5 pages).

* cited by examiner

[Fig.1]
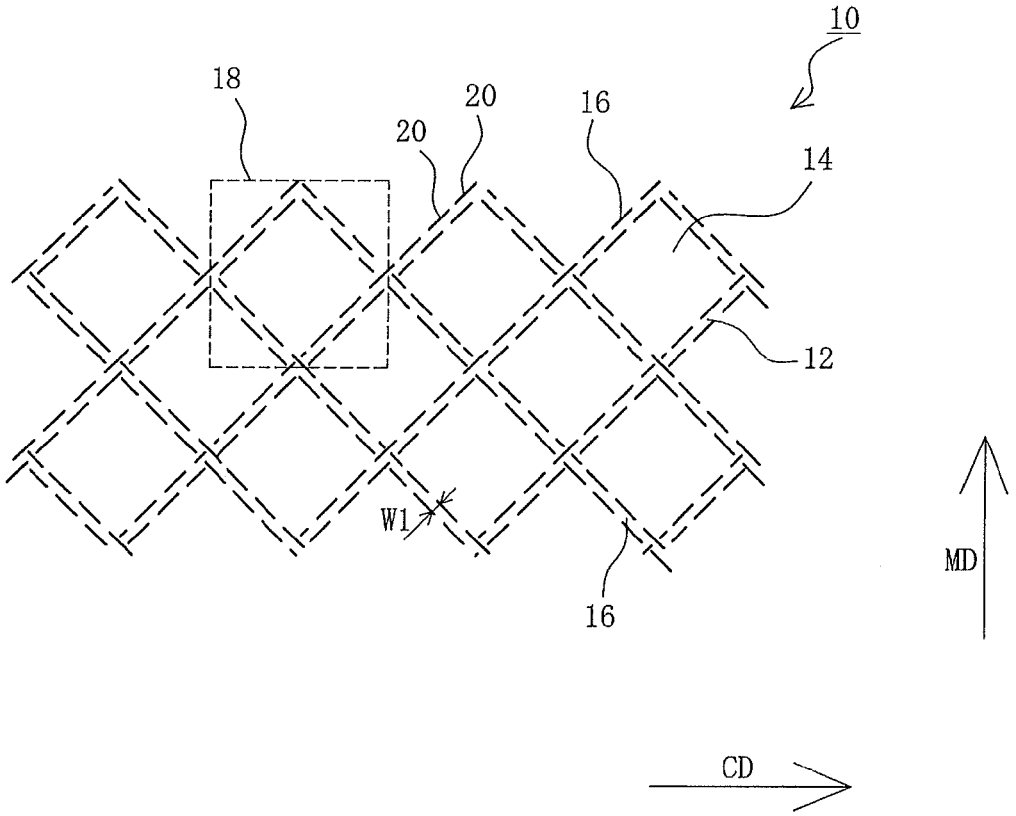

[Fig.2]
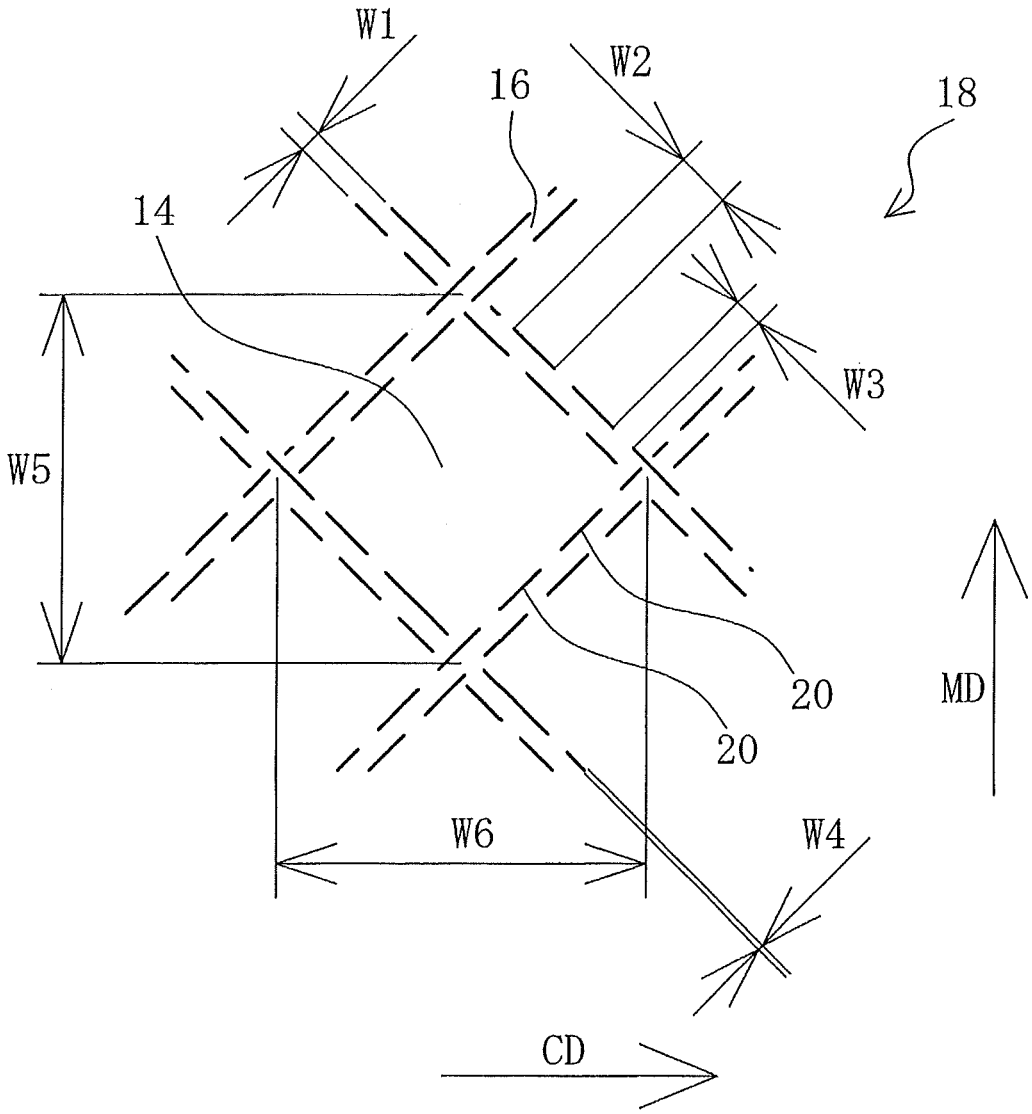

[Fig.3]
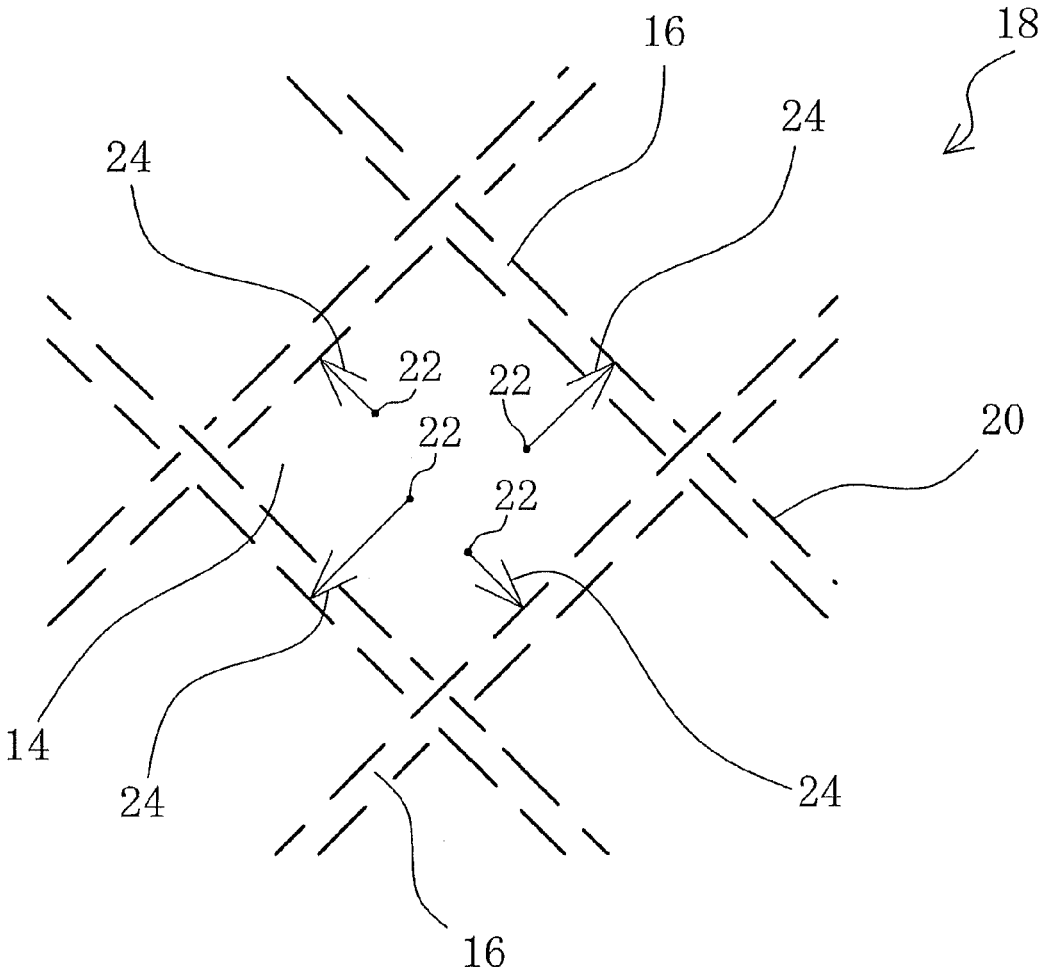

[Fig.4]
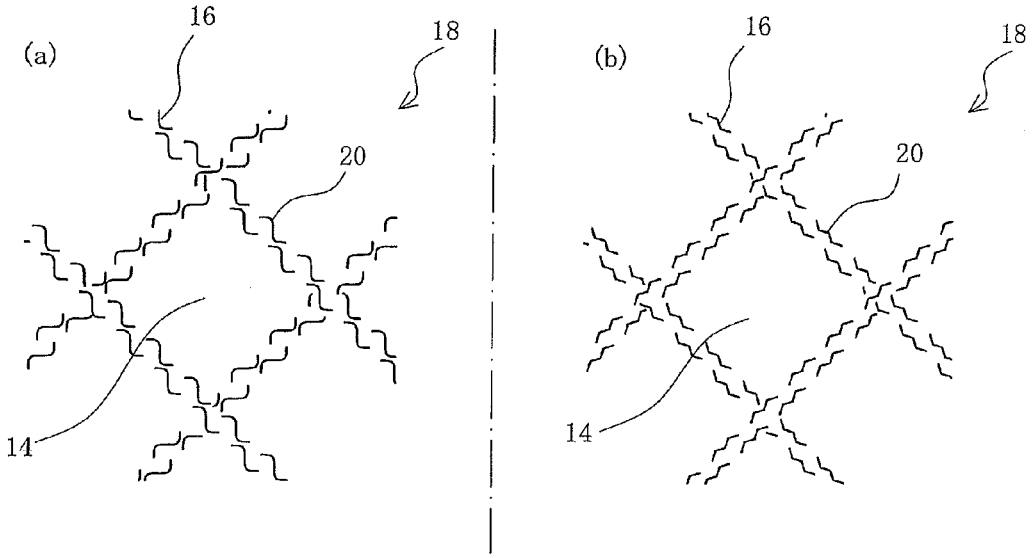

[Fig.5]
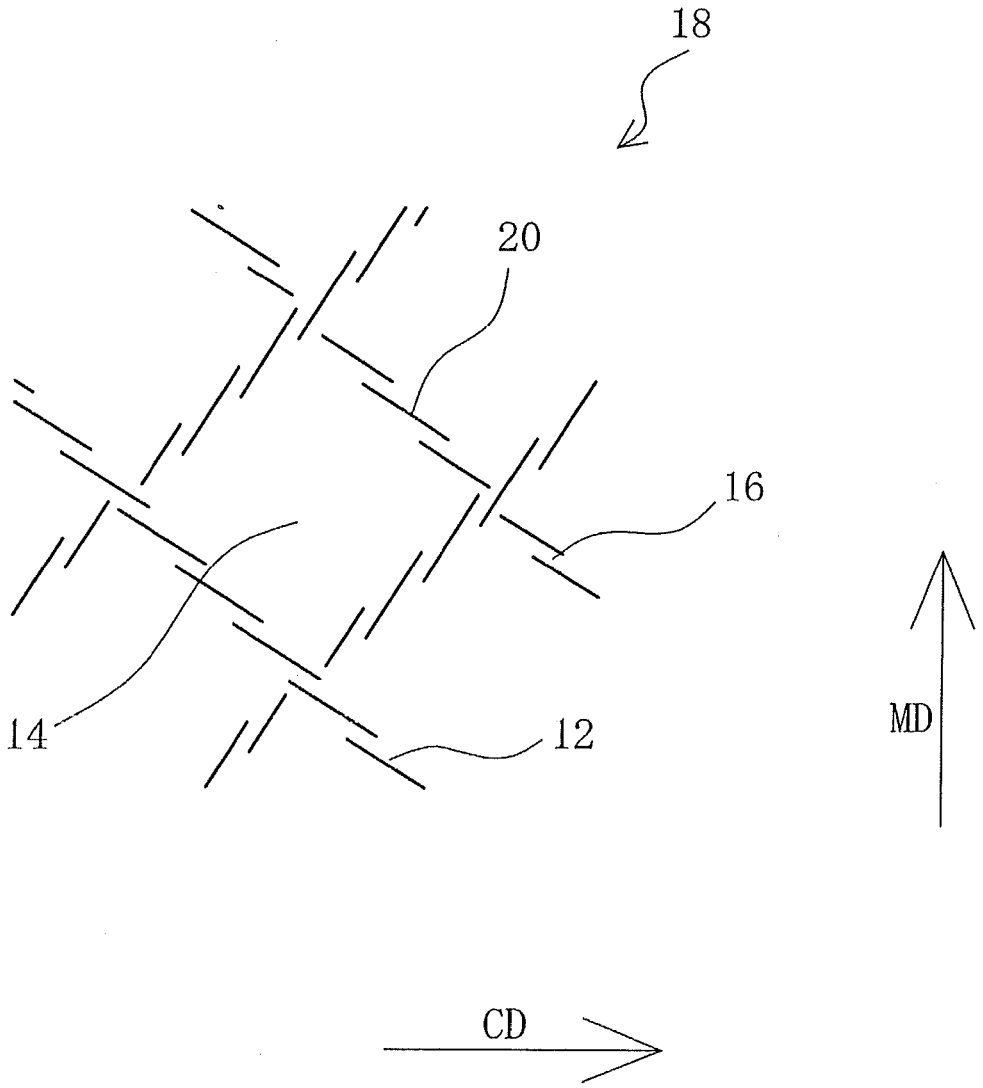

[Fig.6]
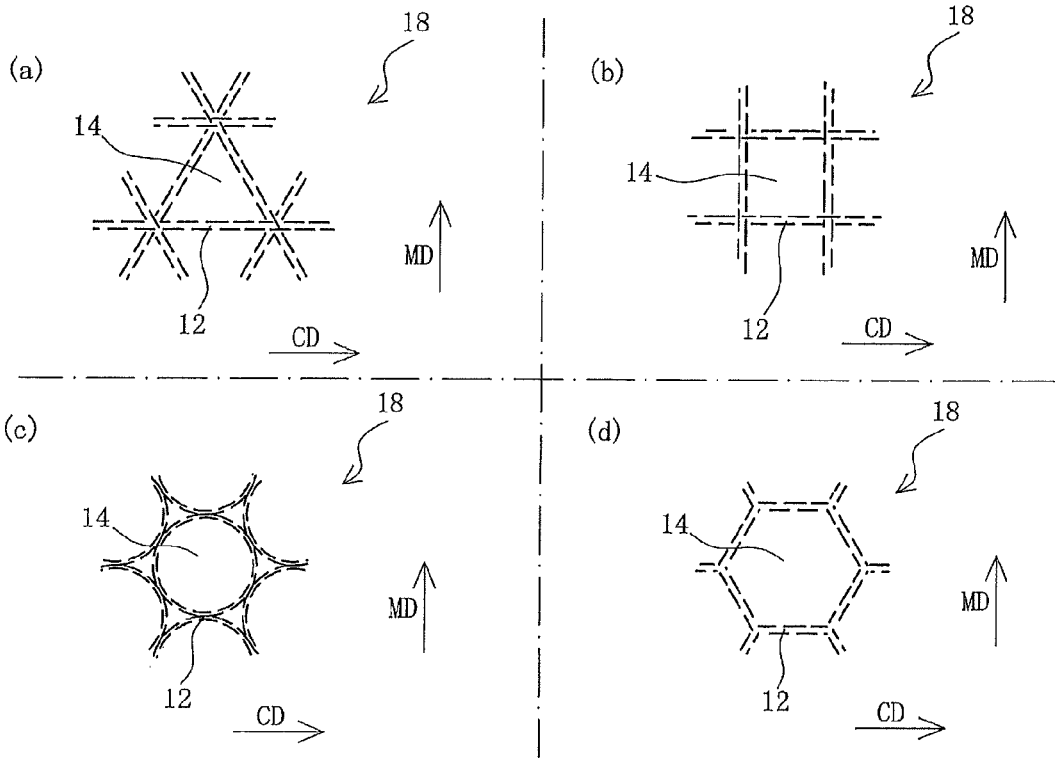

[Fig.7]
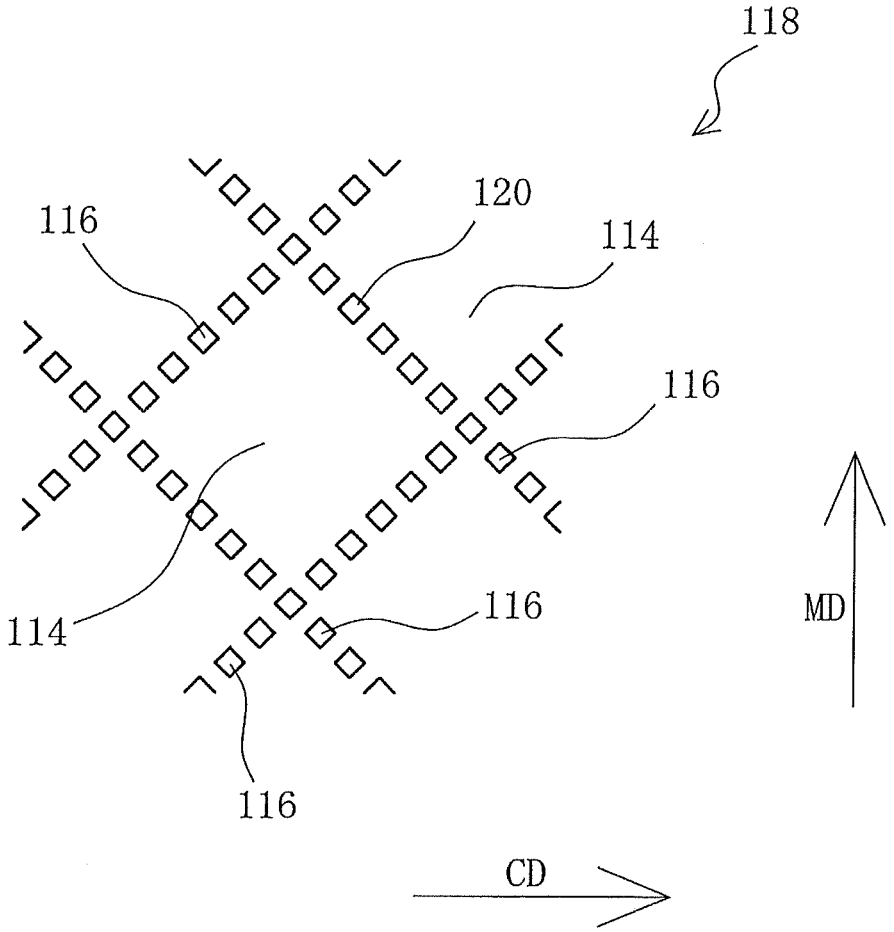

[Fig.8]
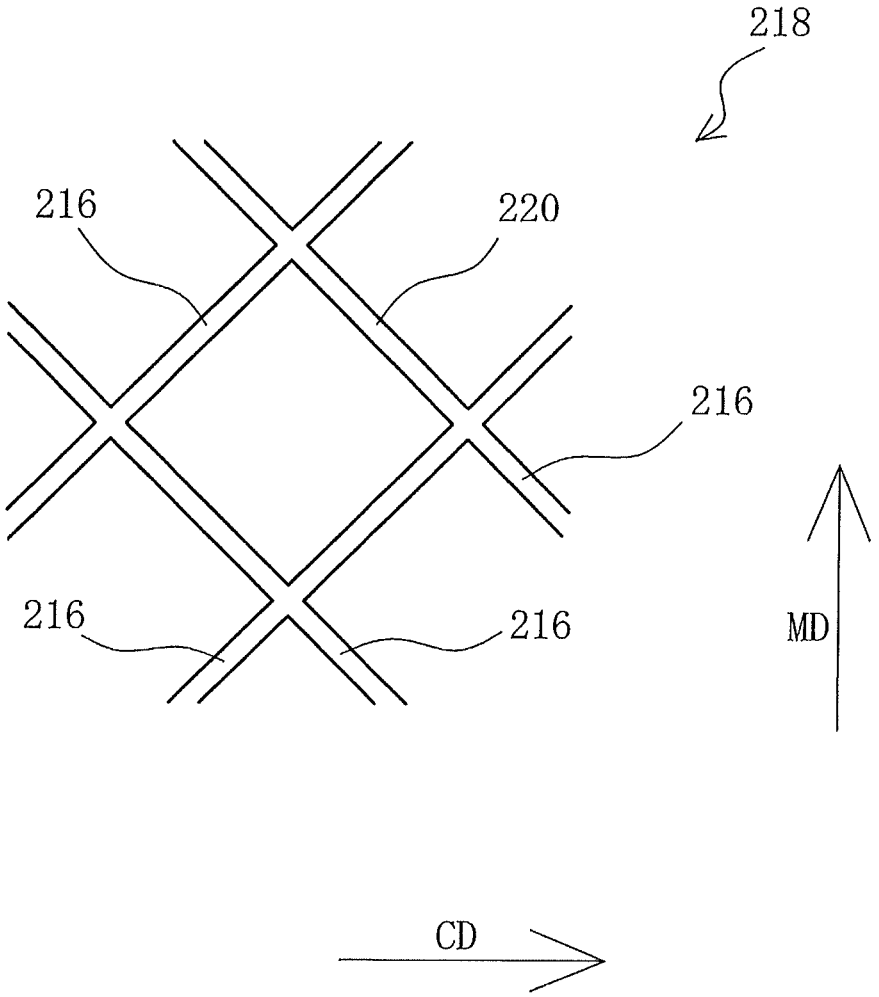

NONWOVEN FABRIC

TECHNICAL FIELD

The present invention relates to a nonwoven fabric comprising an embossed portion and a non-embossed portion.

BACKGROUND ART

Nonwoven fabrics, typified by spunbond nonwoven fabrics, are usually partially thermocompressed (emboss-treated) via an embossing roll in order to prevent the falling-off of fibers which form the nonwoven fabrics.

Emboss patterns (emboss shapes) formed by the thermocompression are usually formed regularly with a predetermined interval in the machine direction (Machine Direction: hereinafter, also referred to as MD) of the nonwoven fabric and in the direction crossing the machine direction (Cross Machine Direction: hereinafter, also referred to as CD).

The emboss patterns considerably affect the properties of the resultant nonwoven fabric such as strength, elongation, softness, resistance to falling-off of fibers and fuzz, and thus various emboss patterns have been proposed.

For example, Patent Literature 1 (JP-A-S57-167442) proposes a nonwoven fabric having an emboss pattern with unit patterns each being in the shape of rhombus or hexagon, wherein the emboss line of the unit pattern is formed by arranging a plurality of shapes such as square point, circular point, line and dotted line, with a predetermined interval.

Patent Literature 2 (JP-A-H11-335960) proposes a nonwoven fabric having an emboss pattern with unit patterns each being in the shape of lattice, wave, line, ellipse or arc, wherein the emboss line of the unit pattern is a straight line.

CITATION LIST

Patent Literatures

[Patent Literature 1] JP-A-S57-167442
[Patent Literature 2] JP-A-H11-335960

SUMMARY OF INVENTION

Technical Problem

However, among these emboss patterns, for example, as shown in FIG. 7, a nonwoven fabric with a rhombus unit pattern 118 which is formed from emboss lines 116 each formed from square points 120, has a problem that fibers markedly lift between a non-embossed portion 114 and a non-embossed portion 114 that are adjacent to each other via the emboss line 116, and tends to be inferior in fuzz resistance.

On the other hand, as shown in FIG. 8, the nonwoven fabric with an emboss pattern delimited in the shape of a lattice (a unit pattern 218 is in the shape of square rhombus) wherein each emboss line 216 is continuous by being a straight line 220, is excellent in fuzz resistance but has a problem that it is inferior in softness.

With such emboss lines in the unit patterns of the embossed portions as proposed in the above Patent Literatures and the like, it is possible to cause a change in fuzz resistance, softness or tensile strength of the resultant nonwoven fabric, but it is difficult to achieve excellent balance among fuzz resistance, softness and tensile strength in the resultant nonwoven fabric.

The present invention has been made in view of such current circumstances. It is an object of the present invention to provide a nonwoven fabric excellent in the balance among fuzz resistance, softness and tensile strength.

Solution to Problem

The present invention has been made to overcome the problems in conventional technique as described above.

The nonwoven fabric of the present invention is directed to a nonwoven fabric comprising an embossed portion and a non-embossed portion, the embossed portion comprising an emboss pattern that comprises unit patterns each delimited by emboss lines, the emboss lines each comprising a plurality of emboss element parts that are continuously arranged with a predetermined interval, wherein in the direction in which the distance from any arbitrarily-defined point in the non-embossed portion within the unit pattern toward the outside of the emboss lines that delimit the non-embossed portion is shortest, at least one of the plurality of emboss element parts is disposed so as to block the direction in which the distance from the arbitrarily-defined point toward the outside of the emboss lines that delimit the non-embossed portion is shortest.

With the nonwoven fabric having such a structure, i.e., the emboss element parts are provided by partial thermocompression and the non-embossed portion is surrounded by the non-continuous embossed portion, fibers do not markedly lift between non-embossed portions that are adjacent to each other via the emboss line, and thereby excellent fuzz resistance is achieved.

Furthermore, such a nonwoven fabric, in which the non-embossed portion is present having some degree of size and the emboss line is non-continuous, is superior in softness to a nonwoven fabric having an emboss pattern formed by a continuous emboss line.

In addition, such a nonwoven fabric has a tensile strength equivalent to that of a conventional nonwoven fabric, and accordingly it is excellent in the balance among fuzz resistance, softness and tensile strength.

In the nonwoven fabric of the present invention, the emboss line is formed by disposing the plurality of emboss element parts with an equal interval from each other so as to form dotted lines.

Such a nonwoven fabric, by having an emboss line that is dotted lines, is at a state of being partially thermocompressed, and thus prevents fibers from markedly lifting between non-embossed portions that are adjacent to each other via the emboss line, and thus is excellent in fuzz resistance.

In the nonwoven fabric of the present invention, the emboss line is formed by continuously disposing the plurality of emboss element parts, each of which is inclined, with an equal interval from each other.

Such a nonwoven fabric, by having an emboss line formed from the plurality of inclined emboss element parts, is at a state of being partially thermocompressed, and thus prevents fibers from markedly lifting between non-embossed portions that are adjacent to each other via the emboss line, and thus is excellent in fuzz resistance.

In the nonwoven fabric of the present invention, the length of the emboss element part is 0.5 to 5 mm, and the interval between the emboss element parts that are disposed so as to form dotted lines is 0.5 to 5 mm.

Such a nonwoven fabric, by having emboss element parts as described above, prevents fibers from markedly lifting between non-embossed portions that are adjacent to each other via the emboss line, and thus excellent in fuzz resistance.

In the nonwoven fabric of the present invention, the shape of the emboss element part is any of a straight line, a curved line and a zigzag shape.

Such a nonwoven fabric, by having an emboss element part shaped as described above, prevents fibers from markedly lifting between non-embossed portions that are adjacent to each other via the emboss line, and thus is excellent in fuzz resistance.

In the nonwoven fabric of the present invention, the unit patterns each delimited by the emboss lines are regularly disposed in the machine direction (Machine Direction) of the nonwoven fabric and in the direction crossing machine direction (Cross Machine Direction).

Such a nonwoven fabric, by having unit patterns disposed regularly, prevents fibers from markedly lifting in any part of the nonwoven fabric, and thus is preferable.

In the nonwoven fabric of the present invention, the unit pattern has a length of the width in the machine direction (Machine Direction) of the nonwoven fabric of 2 to 15 mm, and a length of the width in the direction crossing the machine direction (Cross Machine Direction) of 2 to 15 mm.

Such a nonwoven fabric, by having a unit pattern with lengths as described above, surely prevents fibers from markedly lifting between non-embossed portions that are adjacent to each other via the emboss line.

Such a nonwoven fabric, by having a unit pattern with a size as described above, is excellent in softness, too.

In the nonwoven fabric of the present invention, the line width of the emboss line is 0.5 to 3 mm.

Such a nonwoven fabric, by having an emboss line with a line width as described above, is excellent in the balance among fuzz resistance, softness and tensile strength.

In the nonwoven fabric of the present invention, the unit pattern delimited by the emboss lines is in the shape of rhombus.

Such a nonwoven fabric, by having a rhombus unit pattern, is excellent particularly in the balance among fuzz resistance, softness and tensile strength.

The resultant emboss pattern of the present invention, in which the embossed portion looks sewn, can provide high-quality appearance as seen in woven fabrics, in spite of being the emboss pattern of nonwoven fabrics, and thus the nonwoven fabric of the present invention is also excellent from aesthetic viewpoint.

Advantageous Effect of Invention

According to the present invention, the emboss element parts, which form the emboss lines that delimit the unit pattern, are provided by partial thermocompression, and the non-embossed portion is surrounded by the non-continuous embossed portion. As a result, fibers do not markedly lift between non-embossed portions adjacent to each other via the emboss line, leading to the nonwoven fabric excellent in fuzz resistance. Moreover, the non-embossed portion is present having some degree of size and the emboss line is non-continuous. As a result, the nonwoven fabric is excellent in softness, too. Furthermore, the tensile strength is equivalent to that of a conventional nonwoven fabric. Accordingly, the nonwoven fabric is excellent in the balance among fuzz resistance, softness and tensile strength.

BRIEF DESCRIPTION OF DRAWINGS

FIG. 1 is a front view of a nonwoven fabric comprising an embossed portion and a non-embossed portion in an embodiment of the present invention.

FIG. 2 is an enlarged view focusing on a unit pattern portion of an embossed portion of the nonwoven fabric shown in FIG. 1.

FIG. 3 illustrates how emboss element parts are disposed.

FIG. 4 illustrates other embodiments of emboss element parts. FIG. 4(*a*) illustrates curved emboss element parts, and FIG. 4(*b*) illustrates zigzag emboss element parts.

FIG. 5 is an enlarged view focusing on another unit pattern portion in an embossed portion.

FIG. 6 illustrates other embodiments of a unit pattern. FIG. 6(*a*) illustrates a triangle unit pattern; FIG. 6(*b*) illustrates a rectangle unit pattern; FIG. 6(*c*) illustrates a circle unit pattern; and FIG. 6(*d*) illustrates a testudinarian unit pattern.

FIG. 7 illustrates the structure of an emboss line of a conventional nonwoven fabric.

FIG. 8 illustrates the structure of an emboss line of a conventional nonwoven fabric.

EMBODIMENTS OF DESCRIPTION

<Fiber Material>

A fiber which forms the nonwoven fabric according to the present invention is not particularly limited, and is selected from natural fibers such as cellulose, regenerated fibers such as rayon, synthetic fibers composed of thermoplastic polymers, and the like. Of these fibers, synthetic fibers are preferable, which are suited for the production of nonwoven fabrics.

The thermoplastic polymers serving as raw materials of the synthetic fibers are not particularly limited as long as being capable of being formed into fibers to produce nonwoven fabrics.

Specific examples thereof include polyolefins such as polyethylene and polypropylene, polyolefin elastomers, polystyrene polymers, polystyrene elastomers, polyesters, polyester elastomers, polyamides, polyamide elastomers, polyurethanes and polylactic acids. As the thermoplastic polymer, a combination of two or more kinds of these polymers, or a composition containing two or more kinds of these polymers may be used.

Of the thermoplastic polymers, polyolefins such as polyethylene and polypropylene are preferable. Polypropylene is preferable, which achieves excellent spinning stability during molding operation and processability of nonwoven fabrics, and provides a nonwoven fabric excellent in breathability, softness, lightness and heat resistance.

Examples of the polypropylene include propylene homopolymers and copolymers of propylene with a small amount of one or more kinds of α-olefins having 2 or more carbon atoms (excluding an α-olefin having 3 carbon atoms), preferably α-olefins having 2 to 8 carbon atoms (excluding an α-olefin having 3 carbon atoms), such as ethylene, 1-butene, 1-pentene, 1-hexene, 1-octene and 4-methyl-1-pentene, the homopolymers and the copolymers having a melting point (Tm) of 125° C. or higher, preferably 130 to 165° C.

The thermoplastic polymers may optionally contain commonly-used additives in a range which is not detrimental to the object of the present invention, such as antioxidants, weathering stabilizers, light stabilizers, anti-blocking agents, lubricants, nucleating agents, pigments, hydrophilizing agents, water repellents and assistants.

<Nonwoven Fabric>

The nonwoven fabric according to the present invention is not particularly limited. Examples thereof include various known nonwoven fabrics such as a spunbond nonwoven fabric, a meltblown nonwoven fabric, a wet-type nonwoven fabric, a dry-type nonwoven fabric, a dry-type pulp nonwoven fabric, a flash spinning nonwoven fabric and an open nonwoven fabric.

Of these nonwoven fabrics, a spunbond nonwoven fabric is preferable, since it is formed from long fibers and can be efficiently treated through a continuous step from spinning to emboss treatment, and it can be readily formed into a composite with another nonwoven fabric such as a meltblown nonwoven fabric.

The fiber which forms the nonwoven fabric according to the present invention usually has a fineness of 0.5 to 5 denier, preferably 0.5 to 3 denier. The fiber which forms the nonwoven fabric may be a short fiber, but is preferably a long fiber, for reasons that, e.g., in the case of long fibers, the fibers do not fall off from the resultant nonwoven fabric.

The fiber which forms the nonwoven fabric, when being a synthetic fiber, may be a fiber of a single kind of thermoplastic polymer selected from those described above; or a composite fiber having a core-sheath structure, a side-by-side structure or the like formed from two or more kinds of thermoplastic polymers selected from those described above.

The fiber may have a shape such that its cross-sectional shape is circle or an irregular one such as V-shape, criss-cross-shape and T-shape; or may be a crimped fiber. In particular, a crimped fiber is preferable, which can provide the resultant nonwoven fabric with more improved softness, bulkiness and stretchability.

The nonwoven fabric according to the present invention usually has a basis weight of 3 to 100 g/m$^2$, preferably 7 to 60 g/m$^2$.

<Embossed Portion 12>

As shown in FIG. 1, the nonwoven fabric 10 of the present invention is a nonwoven fabric 10 comprising an embossed portion (thermocompressed portion) 12 and a non-embossed portion (non-compressed portion) 14.

In the specification of the present invention, the embossed portion 12 refers to a portion formed by partially thermocompressing a nonwoven fabric with an embossing roll (not shown in the drawing), while the non-embossed portion 14 refers to the other portion that has not been thermocompressed. Thus, the embossed portion and the non-embossed portion are not formed to provide particular separated regions.

The embossed portion 12 is formed from an emboss pattern formed by repeating an emboss pattern 18 delimited by emboss lines 16. In an embodiment of the present invention, as shown in FIG. 1 and FIG. 2, the unit pattern 18 is in the shape of rhombus.

The line width W1 of the emboss line 16 is preferably 0.5 to 3 mm.

The line width W1 of less than 0.5 mm, which makes the embossed portion (thermocompressed portion) 12 extremely small, may result in the nonwoven fabric 10 being excellent in softness but being insufficient to suppress fuzz.

On the other hand, the line width W1 of more than 3 mm, which increases the interval between the embossed portion (thermocompressed portion) 12 and the embossed portion (thermocompressed portion) 12 and enlarges the non-embossed portion 14, reduces fuzz-preventing effect and may cause fibers to markedly lift through the non-embossed portion 14. In addition, the tensile strength may be reduced. Thus, such a line width is not preferred.

As shown in FIG. 2, the emboss line 16 is formed by continuously arranging a plurality of emboss element parts 20 with a predetermined interval.

In a point where the emboss line 16 and the emboss line 16 intersect one another, too, each emboss element part 20 does not overlap one another, i.e., each emboss element part 20 are spaced from one another.

As shown in FIG. 3, in the direction in which the distance from any arbitrarily-defined point 22 in the non-embossed portion 14 within a unit pattern 18 toward the outside of the emboss lines 16 that delimit the non-embossed portion 14 is shortest, i.e., an arrow 24, a plurality of emboss element parts 20 are formed so as to overlap one another, and the emboss element parts 20 are disposed so as to block this direction.

In an embodiment of the present invention, the emboss element parts 20 are disposed so as to form two dotted lines, and the non-embossed portion 14 (a portion between the emboss element part 20 and the emboss element part 20) on the dotted line does not overlap the non-embossed portion 14 on the adjacent dotted line.

In FIG. 3, the emboss element parts 20 are disposed so as to form two dotted lines, but the number of lines is not particularly limited. More than two lines may be provided as long as the non-embossed portion 14 on the dotted line does not overlap the non-embossed portion 14 on the adjacent dotted line.

The shape of each emboss element part 20, which is a straight line in the above embodiment, is not particularly limited, and may be, for example, a curved line as shown in FIG. 4(*a*), or a zigzag shape as shown in FIG. 4(*b*).

As shown in FIG. 2, the length W2 of the emboss element part 20 is preferably 0.5 to 5 mm.

The length W2 of less than 0.5 mm leads to the difficulty in disposing the emboss element part 20 and makes the embossed portion (thermocompressed portion) 12 itself smaller. This may result in the failure to prevent fuzz, and may lead to inferior durability of an embossing roll, which may be an obstacle to productivity.

On the other hand, the length W2 of more than 5 mm enlarges a continuous part of the embossed portion (thermocompressed portion) 12. This may reduce the softness of the resultant nonwoven fabric 10.

The interval W3 between the emboss element part 20 and the emboss element part 20 (distance of non-embossed portion 14) is preferably 0.5 to 5 mm.

The interval W3 of less than 0.5 mm makes the embossed portion (thermocompressed portion) 12 substantially continuous. This may reduce the softness of the resultant nonwoven fabric 10.

On the other hand, the interval W3 of more than 5 mm increases the interval between the embossed portion (thermocompressed portion) 12 and the embossed portion (thermocompressed portion) 12 and enlarges the non-embossed portion. This reduces fuzz-preventing effect and may cause fibers from markedly lifting through the non-embossed portion. In addition, the tensile strength may be reduced. Thus, such an interval is not preferred.

The thickness W4 of the emboss element part 20 is preferably 0.05 to 1.5 mm, more preferably 0.1 to 1.0 mm.

The thickness W4 of less than 0.05 mm may lead to the difficulty in processing an embossing roll itself for forming the emboss element parts 20 on the nonwoven fabric.

On the other hand, if the thickness W4 is more than 1.5 mm, the emboss line 16 is so thick that the softness may be reduced.

The unit pattern 18 delimited by such emboss lines 16 has a length W5 of the width in the machine direction (MD) of the nonwoven fabric 10, and a length W6 of the width in the direction crossing the machine direction (CD) each preferably being 2 to 15 mm, more preferably 3 to 10 mm.

If the lengths W5 and W6 are each less than 2 mm, the resultant nonwoven fabric 10 tends to be excellent in fuzz resistance but inferior in softness.

On the other hand, if the lengths W5 and W6 are each more than 15 mm, the resultant nonwoven fabric 10 tends to be excellent in softness but cause fibers to markedly lift within the unit pattern 18 and tends to be inferior in fuzz resistance. Furthermore, the tensile strength may be reduced.

The length W5 of the width in the machine direction (MD) of the nonwoven fabric and the length W6 of the width in the direction crossing the machine direction (CD) may be the same as or different from each other.

When the unit pattern 18 is in the shape of rhombus as in an embodiment of the present invention, the length of each side forming the rhombus is preferably 3 to 10 mm.

Thus, as in the embodiment of the present invention shown in FIG. 3, where the unit pattern 18 is in the shape of rhombus, each side forming the rhombus can include about 3 to 10 emboss element parts 20 in view of suitability of emboss roll processing.

In an embodiment of the present invention, the emboss element parts 20 are disposed with an equal interval from each other so as to form dotted lines. In another embodiment, as shown in FIG. 5, the emboss element parts 20 each of which is inclined may be continuously disposed with an equal interval from each other.

As described above, in the nonwoven fabric of the present invention 10, the emboss line 16 is formed by continuously arranging a plurality of emboss element parts 20 with a predetermined interval; and in the direction in which the distance from any arbitrarily-defined point 22 in the non-embossed portion 14 within the unit pattern 18 toward the outside of the emboss lines 16 that delimit the non-embossed portion 14 is shortest, i.e., arrow 24, a plurality of emboss element parts 20 are formed so as to overlap one another, and the emboss element parts 20 are disposed so as to block the direction in which the distance is shortest, i.e., arrow 24.

Such a structure achieves superior balance among fuzz resistance, softness and tensile strength, as compared with a conventional embodiment in which emboss lines delimiting a unit pattern are formed by continuously disposing square points or are straight lines.

The nonwoven fabric 10 of the present invention overcomes the problem that fibers markedly lift between the unit patterns adjacent to each other via the non-embossed portion, which problem has been seen particularly in conventional embodiments in which the emboss line is a dotted line, and therefore is excellent in fuzz resistance.

The nonwoven fabric 10 of the present invention also has a tensile strength equivalent to that of a conventional fabric, and accordingly is excellent in the balance among fuzz resistance, softness and tensile strength.

No nonwoven fabric has been provided which is excellent particularly in the balance among fuzz resistance and softness, and thus the nonwoven fabric of the present invention can be suitably used for sanitary materials, particularly for materials of disposable diapers.

Specifically, in the application to a back sheet of the disposable diaper, while the fuzz is suppressed, the softness can be significantly improved, as compared with a conventional nonwoven fabric. In this application, the use of a crimped fiber as a fiber which forms the nonwoven fabric can further improve the softness.

Superiority in softness of the nonwoven fabric of the present invention suggests its excellent feel and its easy secondary processability.

For example, even when subjected to ring roll processing, gear stretch processing, shape-processing, pleat processing or the like, the nonwoven fabric is not ruptured and has a high degree of freedom about its deformation. The use of a crimped fiber as a fiber which forms the nonwoven fabric imparts the stretchability of the crimped fiber to the nonwoven fabric, which results in having higher degree of freedom about its processability. In some cases, the nonwoven fabric is employable also as part of a stretchable material.

On the other hand, when a raw material has a hydrophilizing agent kneaded thereto or is coated with a hydrophilizing agent, the nonwoven fabric of the present invention is suitably employable as a top sheet of a disposable diaper.

Since the top sheet is a material contacting with skin, its softness is prioritized. The emboss pattern of the nonwoven fabric of the present invention provides excellent softness, and thus is suitable.

The use of a crimped fiber as a fiber can further improve softness felt by skin. In addition to the softness felt by skin, significant issues with regard to the top sheet include whether the top sheet can prevent a liquid from returning from an absorber.

To overcome the liquid-returning problem, it is known to thicken a nonwoven fabric to thereby prevent the liquid-returning. The nonwoven fabric of the present invention is easy to thicken, because in the nonwoven fabric, the non-embossed portion is present having some degree of size. The use of a crimped fiber as a fiber which forms the nonwoven fabric can further thicken the nonwoven fabric.

Hereinabove, preferable embodiments of the present invention are described, but the present invention is not limited to the above embodiments. For example, in the embodiment described above, the shape of the unit pattern 18 of the embossed portion 12 is rhombus, but the present invention is not limited thereto. As shown in FIG. 6, exemplary shapes include triangle shape (FIG. 6(*a*)), rectangle shape (FIG. 6(*b*)), polygonal shape, circular shape (FIG. 6(*c*)), star shape, testudinarian shape (FIG. 6(*d*)) and character design shape. That is, any shape is employable as long as having a closed shape and being capable of providing a repeating structure. The shape may be modified in various ways in a range that does not deviate from the object of the present invention.

EXAMPLES

<Nonwoven Fabric Sample for Evaluation and Basis Weight of this Nonwoven Fabric Sample>

In accordance with JIS-L1096-1990, 6.4.2, "mass per unit area under standard conditions", the basis weight was measured. From a nonwoven fabric sample prepared, a circular test piece of 100 $cm^2$ was collected.

The samples were collected at a place that was arbitrarily determined in the machine direction (MD) and were collected at 20 points with a uniform interval that would form a straight line in the direction crossing the machine direction (CD). The samples were not collected at a place between each end and 20 cm inward from each end of the nonwoven fabric sample in the direction crossing the machine direction (CD).

Using pan electronic balance (EB-330 manufactured by Shimadzu Corporation), a mass (g) of each test piece collected was measured. Then, an average mass (g) of the test pieces was calculated.

The average mass calculated was converted to amass (g) per 1 $m^2$, and rounded to one decimal place to provide a basis weight ($g/m^2$) of each nonwoven fabric sample.

(1) Evaluation of Fuzz Resistance

From the nonwoven fabric sample prepared, 40 test pieces each having a size of 300 mm (MD)×25 mm (CD) were collected, and the fuzz resistance was evaluated using an apparatus, "rubbing tester II (Gakushin-type)" described in JIS-L0849-2004, 5, 5.1, b.

Specifically, as such an apparatus, RT-100 manufactured by DAIEI KAGAKU SEIKI MFG. Co., Ltd. was employed. A 200 g friction block was used. A packing adhesive tape (cloth) No. 314 (manufactured by Rinrei Tape Co., Ltd.) was placed such that the adhesive surface of the adhesive tape would rub the testing surface of the test piece.

To prevent the test piece from moving during the test, sandpaper (No. 400) was fitted to a table of the apparatus with the abrasive surface upward. The test piece was placed on the abrasive surface and was fitted to the tester table with the testing surface upward.

After the fitting of the test piece, the testing surface of the test piece and the non-adhesive surface of the adhesive tape were rubbed against each other back and forth 50 times. The rubbed testing surface of the test piece was observed, and the fuzz resistance was graded based on the following criteria.

1 point: There was no fuzz.

2 points: A small fuzzball started to form.

3 points: A recognizable fuzzball started to form, and a plurality of small fuzzballs formed.

4 points: Recognizable large fuzzballs formed, and a plurality of fibers started to lift.

5 points: Fibers were considerably torn off and the test piece became thin.

6 points: Fibers were torn off and the test piece was broken.

(2) Evaluation of Tensile Strength

With the width of the nonwoven fabric test piece being 25 mm, the distance between chucks being 100 mm, and the tensile rate being 100 mm/min, tensile test was performed in two directions: the machine direction (MD) and the direction crossing the machine direction (CD), and a maximum tensile load was defined as tensile strength (N/25 mm). The measurement was performed five times and an average value of the values obtained five times was calculated.

(3) Evaluation of Softness

In accordance with JIS L1096 (6.19.1 A method), in a constant temperature chamber at a temperature of 20±2° C. and a humidity of 65±2% as specified in JIS 28703 (standard conditions for testing), five test pieces each 20 mm in width×150 mm were collected in the machine direction (MD). Each test piece was placed on a horizontal, smooth-surface table having a 45° slope surface, with the shorter side of the test piece aligned at the scale baseline.

The test piece was slowly slid toward the slope surface by hand. When the central point on one edge of the test piece touched the slope surface, the length by which the other edge had moved was measured by reading the scale. The flexural rigidity was represented by length (mm) by which the test piece had moved. Each of the five test pieces was tested on both the front and back surface, and an average value was calculated.

Under the measurement method so-called 45° cantilever method, the test piece of the nonwoven fabric that has moved by a shorter length (mm) is determined to have more softness.

In general, when the flexural rigidity value is 50 mm or less, the softness is determined to be good. However, no limitation is necessarily made to this value, since required softness vary depending on use purpose and the like.

(4) Evaluation of Emboss Pattern after Rubbing

In accordance with ASTM D-5264, a nonwoven fabric test piece 110 mm in width in the machine direction (MD) and 40 mm in width in the direction crossing the machine direction (CD) of the nonwoven fabric was prepared.

This nonwoven fabric test piece was fitted to a specimen holder of Sutherland Ink Rub Tester, and was rubbed ten times with #40 sandpaper.

Then, the nonwoven fabric test piece was placed on a black cardboard, and was photographed from a height distant from the test piece by 30 cm.

The photograph was enlarged, and in a 30 mm square region, the emboss pattern was observed.

When 50% or more of the embossed portion was recognizable, the emboss pattern was evaluated as "recognizable". When less than 50% of the embossed portion was recognizable, the emboss pattern was evaluated as "unrecognizable".

Example 1

As a first propylene polymer, a propylene homopolymer having a melting point of 162° C. and MFR (measured in accordance with ASTM D1238 at a temperature of 230° C. under a load of 2.16 kg, this applies hereinafter unless noted particularly otherwise) of 60 g/10 min was used. As a second propylene polymer, a propylene.ethylene random copolymer having a melting point of 142° C., MFR of 60 g/10 min and 4.0 mol % of an ethylene unit component was used. These were subjected to composite melt spinning by spunbond method. Then, an eccentric core-sheath composite fiber comprising the propylene homopolymer as a core and the propylene.ethylene random copolymer as a sheath (core/sheath=20/80 (weight ratio)) was deposited on a collecting surface.

In such a manner as to provide a emboss pattern as shown in FIG. 2 (embossed area percentage: 10%, width of emboss line: 0.25 mm, length of emboss element part: 1.0 to 1.5 mm, interval between emboss element parts: 0.5 to 1.0 mm), emboss processing was performed at an embossing rate 5 m/min and at an embossing temperature of 110° C., to thereby produce a nonwoven fabric having a basis weight of 30 $g/m^2$ and comprising a crimped composite fiber having a fineness of structural fibers of 2.5 denier.

The resultant nonwoven fabric was subjected to evaluations as in the above items (1) to (4). The evaluation result is shown in Table 1.

Comparative Example 1

The operation was performed in the same manner as in Example 1, except that the emboss line of the unit pattern of the embossed portion shown in FIG. 2 was replaced with an emboss line formed by arranging a plurality of square point shapes with an equal interval as shown in FIG. 7. Then, evaluations (1) to (4) described above were performed. The evaluation result is shown in Table 1.

Comparative Example 2

The operation was performed in the same manner as in Example 1, except that the emboss line of the unit pattern of the embossed portion shown in FIG. 2 was replaced with an emboss line that was a straight line as shown in FIG. 8, and the embossed area percentage was 24%. Then, evaluations (1) to (4) described above were performed. The evaluation result is shown in Table 1.

TABLE 1

| | | Examples | | |
|---|---|---|---|---|
| | | Ex. 1 | Comp. Ex. 1 | Comp. Ex. 2 |
| Unit pattern shape of embossed portion | | FIG. 2 | FIG. 7 | FIG. 8 |
| Area percentage | % | 10% | 10% | 24% |
| Core/sheath ratio | | 20/80 | 20/80 | 20/80 |
| Basis weight | $g/m^2$ | 30 | 30 | 30 |
| Embossing rate | m/min | 5 | 5 | 5 |
| Embossing temperature | ° C. | 110 | 110 | 110 |
| Fuzz resistance | point | 2 | 4 | 2 |
| MD tensile strength | N/25 mm | 20 | 21 | 22 |
| CD tensile strength | N/25 mm | 8 | 9 | 8 |
| Flexural rigidity | mm | 33 | 38 | 52 |
| Emboss pattern after rubbing | visual observation | Recognizable | Unrecognizable | Recognizable |

According to the evaluation result, the following was made clear. With regard to (1) fuzz resistance, Example 1 was found to have fuzz resistance equivalent to that of Comparative Example 2. Comparative Example 1 was found to have inferior fuzz resistance, as compared with Example 1 and Comparative Example 2.

With regard to (2) tensile strength, both in the machine direction (MD) and in the direction crossing the machine direction (CD), Example 1 had equivalent values to the values of Comparative Examples 1 and 2, and thus Example 1 was found to have equivalent tensile strength to that of Comparative Examples.

With regard to (3) softness, Example 1 had a smaller value than the values of Comparative Example 1 and 2, and thus Example 1 was found to have an emboss pattern superior in softness as compared with Comparative Example 1 and 2.

With regard to (4) emboss pattern after rubbing, Example 1 and Comparative Example 2 were found to have recognizable emboss patterns after rubbing, while Comparative Example 1 was found to have an unrecognizable emboss pattern after rubbing.

It was thus found that the nonwoven fabric of the present invention shown in Example 1 was superior particularly in softness as compared with conventional nonwoven fabrics shown in Comparative Example 1 and 2; was superior in fuzz resistance to Comparative Example 1 and was good equivalently to Comparative Example 2; was equivalent in tensile strength to Comparative Example 1 and 2, and therefore was excellent in the balance among fuzz resistance, softness, and tensile strength.

Furthermore, it was found that the emboss pattern after rubbing of the nonwoven fabric of the present invention was recognizable equivalently to Comparative Example 2. It was thus clear that the emboss pattern was retained even through repeated use and the nonwoven fabric of the present invention was excellent in durability, too.

REFERENCE SIGNS LIST

10 . . . nonwoven fabric
12 . . . embossed portion
14 . . . non-embossed portion
16 . . . emboss line
18 . . . unit pattern
20 . . . emboss element part
22 . . . arbitrarily-defined point
24 . . . arrow
W1 . . . width of emboss line
W2 . . . length of emboss element part
W3 . . . interval between emboss element part and emboss element
W4 . . . thickness of emboss element part
W5 . . . length of width in MD of unit pattern
W6 . . . length of width in CD of unit pattern
114 . . . non-embossed portion
116 . . . emboss line
118 . . . unit pattern
120 . . . square point
216 . . . emboss line
218 . . . unit pattern
220 . . . straight line

The invention claimed is:

1. A spunbonded nonwoven fabric comprising an embossed portion and a non-embossed portion, the embossed portion comprising an emboss pattern that comprises unit patterns each delimited by emboss lines, the emboss lines each comprising a plurality of emboss element parts that are continuously disposed with an equal interval from each other so as to form dotted lines, wherein in the direction in which the distance from any point in the non-embossed portion within the unit pattern toward the outside of the emboss lines that delimit the non-embossed portion is shortest, at least one of the plurality of emboss element parts in the unit pattern is disposed so as to block the direction in which the distance from the point toward the outside of the emboss lines that delimit the non-embossed portion is shortest, and in all the points where two of the emboss lines intersect one another, each emboss element part is spaced from one another such that each emboss element part does not overlap one another.

2. The spunbonded nonwoven fabric according to claim 1, wherein the plurality of emboss element parts are parallel to each other, with an equal interval from each other.

3. The spunbonded nonwoven fabric according to claim 1, wherein the length of the emboss element part is 0.5 to 5 mm, and the interval between the emboss element parts that are disposed so as to form dotted lines is 0.5 to 5 mm.

4. The spunbonded nonwoven fabric according to claim 1, wherein the shape of the emboss element part is any of a straight line, a curved line and a zigzag shape.

5. The spunbonded nonwoven fabric according to claim 1, wherein the unit patterns each delimited by the emboss lines are regularly disposed in the machine direction of the nonwoven fabric and in the direction crossing machine direction.

6. The spunbonded nonwoven fabric according to claim 5, wherein the unit pattern has a length of the width in the machine direction of the nonwoven fabric of 2 to 15 mm, and a length of the width in the direction crossing the machine direction of 2 to 15 mm.

7. The spunbonded nonwoven fabric according to claim 1, wherein the line width of the emboss line is 0.5 to 3 mm.

8. The spunbonded nonwoven fabric according to claim 1, wherein the unit pattern delimited by the emboss lines is in the shape of rhombus.

9. The spunbonded nonwoven fabric according to claim 1, wherein the shape of the emboss element part is a curved line shape.

10. The spunbonded nonwoven fabric according to claim 1, wherein the shape of the emboss element part is a zigzag shape.

* * * * *